US005398627A

United States Patent [19]

Nishikawa

[11] Patent Number: 5,398,627

[45] Date of Patent: Mar. 21, 1995

[54] THREAD CHAIN AND METHOD AND APPARATUS FOR DRAWING OUT THE THREAD CHAIN ON MULTIPLE NEEDLE SEWING MACHINES

[75] Inventor: Masahiko Nishikawa, Osaka, Japan

[73] Assignee: Pegasus Sewing Machine Mfg. Co., Ltd., Osaka, Japan

[21] Appl. No.: 51,481

[22] Filed: Apr. 22, 1993

[30] Foreign Application Priority Data

Apr. 28, 1992 [JP] Japan ..... 4-110192

[51] Int. Cl.[6] ..... D05B 1/10

[52] U.S. Cl. ..... 112/262.1; 112/165; 112/260

[58] Field of Search ..... 112/262.1, 165, 254, 112/255, 260

[56] References Cited

U.S. PATENT DOCUMENTS

| | | | |
|---|---|---|---|
| 1,305,051 | 5/1919 | Berger, Jr. | 112/260 |
| 3,100,469 | 8/1963 | Washburn | 112/260 |
| 3,358,631 | 12/1967 | Sharp | 112/260 |
| 4,175,500 | 11/1979 | Radice et al. | 112/260 X |
| 4,186,676 | 2/1980 | Villa et al. . | |
| 4,726,308 | 2/1988 | Aida et al. | 112/165 X |
| 5,027,728 | 7/1991 | Prina . | |
| 5,154,129 | 10/1992 | Schips | 112/260 X |

*Primary Examiner*—Clifford D. Crowder
*Assistant Examiner*—Paul C. Lewis
*Attorney, Agent, or Firm*—Flynn, Thiel, Boutell & Tanis

[57] ABSTRACT

A sewing machine possessing multiple needles and a single looper for forming a double chain stitch without an upper covering thread capable of drawing out a thread chain reliably and smoothly. By using an auxiliary blade disposed parallel to a looper, the thread chain consecutive to the looper is supported, thereby preventing the thread chain from being pushed down beneath a throat plate by descending needles. On the throat plate, a stitch formation tongue composed of a movable slender plate is provided, and this tongue is withdrawn when making the thread chain. The sewing machine is provided with tension regulators for sewing and for forming a thread chain respectively. In the tension regulators for forming the thread chain, the tension of the right needle thread is set lower than the tension of the looper thread. By use of a rear feed dog, the thread chain is drawn out through a guide groove at the left rear end of a needle hole toward the middle of the rear feed dog.

12 Claims, 7 Drawing Sheets

THREAD CHAIN AND METHOD AND APPARATUS FOR DRAWING OUT THE THREAD CHAIN ON MULTIPLE NEEDLE SEWING MACHINES

BACKGROUND OF THE INVENTION

1. Field of the Invention

The invention relates to a method and apparatus for drawing out a thread chain reliably and smoothly on a sewing machine of a type which forms multiple-needle stitches (U.S. Federal Standard stitch type 406 or 407) by at least two needles and one looper, and a novel thread chain that can be formed by the sewing machine of this type.

2. Description of the Prior Art

In a sewing machine of a type which forms stitches by using multiple needles and one looper, such as a multiple-needle, double chain stitch sewing machine which does not use a upper cover thread, it is essential to form a thread chain smoothly between consecutive fabrics in order to feed the fabrics one after another and sew intermittently by continuous operation of the sewing machine.

In conventional sewing machines of the above type, however, after sewing one fabric, the thread chain linked to the sewing end is pushed down beneath the throat plate as the needles descend, and therefore, in the next step, when the looper goes out to pick up the needle thread loop, it simultaneously hooks the pressed-down thread chain, and the thread chain cannot be delivered. Moreover, the right and left needle threads cannot maintain a specific interval therebetween unless there is a fabric for sewing, and are unable to form uniform stitches, thereby making it impossible to draw out and deliver the thread chain onto the throat plate by holding it with a feed dog behind the feeding direction of the stitch making zone, so that the thread chain cannot be made reliably. Accordingly, hitherto, in this kind of sewing machine, when the fabric reached the sewing end, the machine was stopped and the threads were trimmed, and after removing the sewn fabric, the forward end of the next fabric was fed on the throat plate beneath the presser foot, and the presser foot was lowered to resume the sewing operation, and therefore, it was impossible to sew by feeding the fabrics one after another by operating the sewing machine continuously.

In this kind of sewing machine, it is also proposed to form a thread chain by the sewing machine. An example is disclosed in Japanese unexamined patent publication number 3-23887 (U.S. Pat. No. 5,027,728), in which a thread brake device is positioned at the lower side of the stitch formation tongue formed by a U-shaped needle hole in the throat plate, and at the end of sewing, the same stitch as the one formed on the fabric is formed on the thread brake device to hold the thread chain and prevent its descent due to the lowering of the needles, and the formed thread chain is delivered by a rear feed dog disposed in its feed direction to make the thread chain.

Another sewing machine for forming a thread chain is proposed in Japanese patent publication number 57-58191 (U.S. Pat. No. 4,186,676), in which the thread tension of the right needle of two needles is released at the end of sewing, and the right needle thread does not resist a force pulling it toward the left needle thread by the looper thread, and the thread chain is sent out by the rear feed dog and an auxiliary feed member disposed at the delivery side of the needle hole.

SUMMARY OF THE INVENTION

It is hence a primary object of the invention to provide a method and apparatus for drawing out the thread chain more stably and smoothly than the conventional sewing machines described above, and more particularly, to provide a thread chain, which hardly unravels, is uniform in balance, and can be formed by the aforesaid multiple-needle sewing machine.

It is one of the features of the invention that the thread chain is prevented from being hooked by the looper as it is pushed down by the descending needle and dropped beneath the throat plate, by supporting the thread chain adjacent to the looper by an auxiliary blade which is disposed parallel to the looper and makes elliptical motions back and forth, and right and left, together with the looper.

The formed thread chain is fled to the middle of the rear feed dog through a guide groove formed in the throat plate upper surface in a direction opposite to the cloth feed direction on the needle plate by the feeding action of the rear feed dog.

The tongue formed by the U-shaped needle hole of the throat plate is preferably retractable, and retracts in the cloth feeding direction at the end of sewing. Hence, the right and left needle threads approach each other and assemble into one body, and thereby are delivered smoothly.

It is another feature of the invention to support a thread chain adjacent to the looper by a thread chain supporting means, such as said auxiliary blade, and reduce the tension of one of the two needle threads and increase the tension of the looper thread at the end of sewing. By the tension changeover, the needle thread having the lower tension is shifted to the other needle thread side having the higher tension to form a thread chain as one uniform string, so that the delivery of the thread chain by the rear feed dog may be smooth. In this case, too, the tongue is retractable, and it is preferred that it may withdraw from the needle hole at the end of sewing so as not to interfere with the shift of the needle thread.

In the present invention, too, it is desired to form a guide groove in the throat plate upper surface so that the formed thread chain may be led to the middle of the rear feed dog through the guide groove. In this case, the guide groove is formed toward the middle of the rear feed dog from the needle hole of the side to which the needle thread is shifted.

As the two groups of tension changeover means, tension regulators are provided. One of the two groups has three tension regulators by sewing the fabric for properly setting the tension of two needle threads and one looper thread, and another group has three tension regulators for forming the thread chain, and when sewing the fabric, the tension regulators of the latter group are released, and the tension is applied by the tension regulators of the former group, and when forming the thread chain at the end of sewing, the tension regulators of the former group are released and the tension regulators of the latter group are used, thereby changing over the two groups.

A straight inside edge, which extends from a needle penetrating point of a large diameter along a needle penetration path to the end of the tongue, of a needle hole formed in a U-shape in the throat plate, allows the needle thread to slip out smoothly from the needle penetrating path without being caught when the needle thread tension is relaxed.

The thread chain of the present invention consists of a first needle thread alternately having repeating open loops at its top and bottom in a corrugated form, a second needle thread having continuously repeating closed loops parallel to the first needle thread, and a looper thread having continuously repeating open loops for linking the first and second needle threads. The n-th loop of the looper thread passes through the inside bottom of the bottom of the m-th loop of the first needle thread by passing inside the second needle thread loop, and further, the end of its loop winds around the upper outside of the bottom of the m+1-th loop of the first needle thread, and the n+1-th loop of the looper thread passes through the bottom of the bottom of the m+1-th loop of the first needle thread.

The thread chain of the present invention hardly unravels and is uniform in balance because of the thread entanglement.

Other features and advantages of this invention will be clearly understood from the appended description referring by way of a non-limiting example to an embodiment shown on the accompanying figures of drawings.

DESCRIPTION OF THE PREFERRED EMBODIMENT

Figure 3:
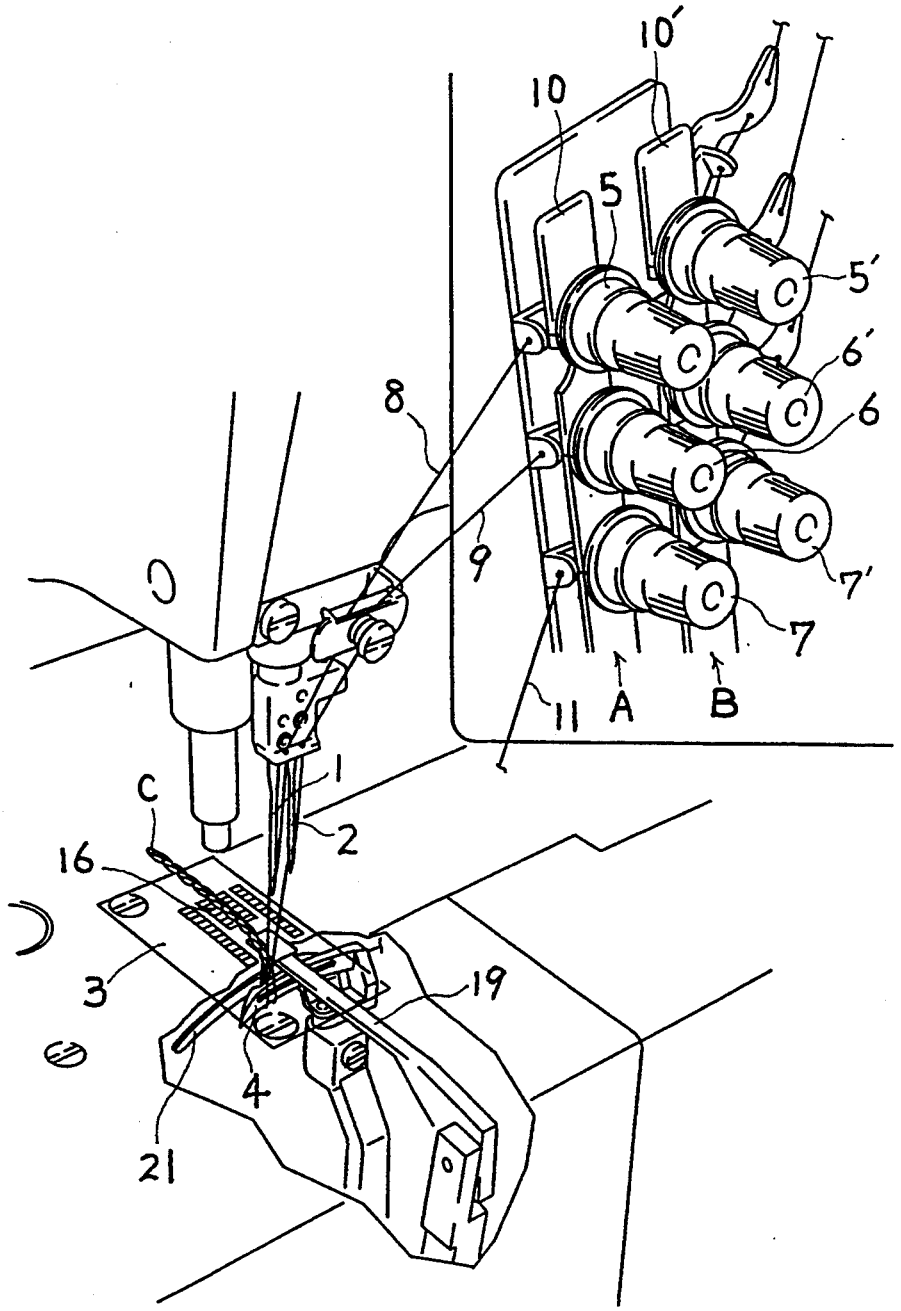
FIG. 3 is a partial perspective view of a flat sewing machine.

FIG. 3 partially shows a flat sewing machine for forming a double-chain stitch with a lower cover thread (JIS B 9070 D23A, i.e. U.S. Federal Standard stitch type 406) by cooperation with a left needle 1, a right needle 2, and a looper 4 beneath the throat plate 3, wherein tensioning means composed of tension regulators 5, 5' for a left needle thread 8, tension regulators 6, 6' for a right needle thread 9, and tension regulators 7, 7' for a looper thread 11 are disposed in parallel in two rows A, B on the stand (not shown) rising from the bed. The tension device of the first row A is composed of tension regulators 5, 6, 7 and the tension regulators 5 and 6 are designed to provide the needle threads 8 and 9 with a tension suitable for sewing, while the tension regulator 7 is set so as to provide the looper thread 11 with a weak tension suitable for sewing.

The tension device of the second row B is composed of tension regulator 5', 6', 7' and used for forming a thread chain C, and the tension regulator 5' provides the needle thread 8 with the proper tension, as when forming a stitch, the tension regulator 6' provides the needle thread 9 with a low tension, and the tension regulator 7' is set to provide the looper thread 11 with a high tension. The tension devices of both rows A, B are respectively equipped with thread loosening plates 10, 10', and by moving them the tension devices are changed over to release one side when using the other one. That is, when forming a stitch on the fabric, the tension device of the first row A is used, while the tension device of the second row B is released, but when the sensor (not shown) for detecting the passing of the fabric end through the needle location detects the fabric end, the tension devices are changed over, and the tension device of the first row A is released while the tension device of the second row B is activated, so that the threads are provided with the tension of this tension device of the second row B.

Figure 4:
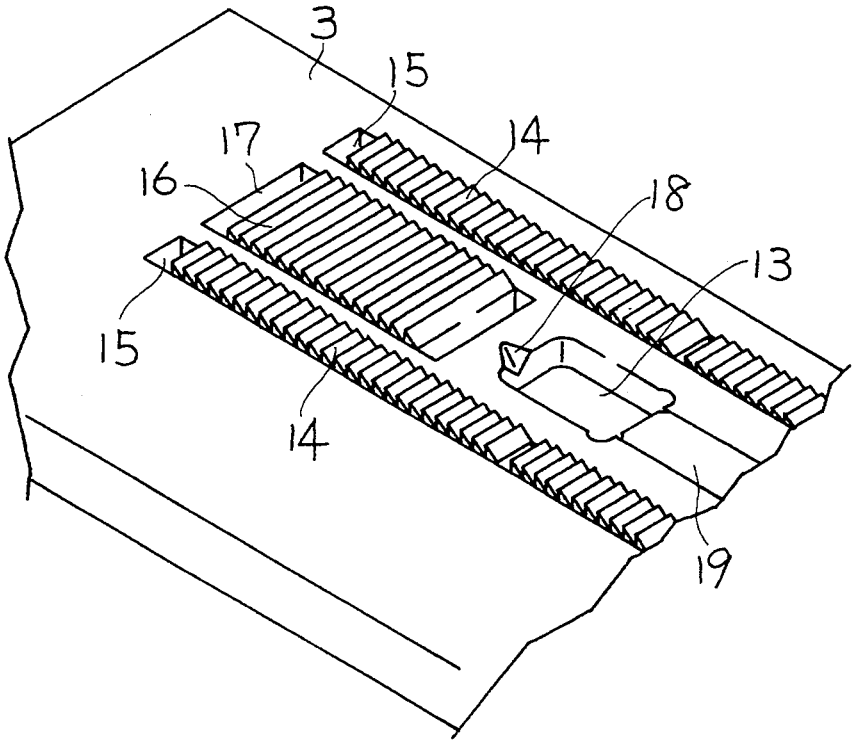
FIG. 4 is a partial perspective view of another throat plate.
Figure 5:
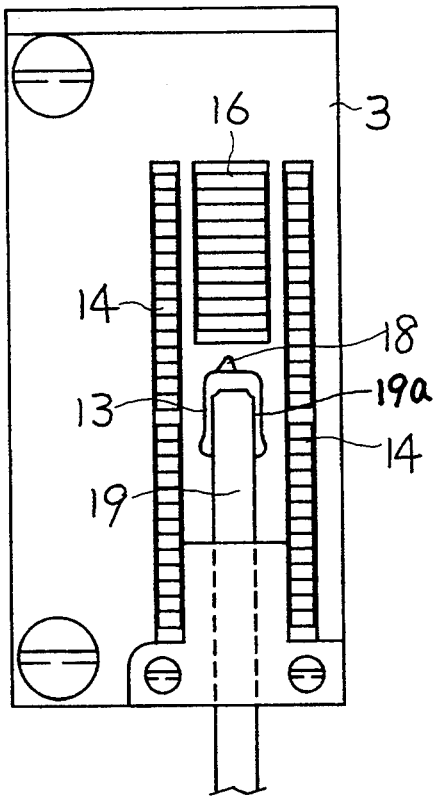
FIG. 5 is a plan view showing the sewing state when the front end of a slender plate projects into the needle hole.
Figure 6:
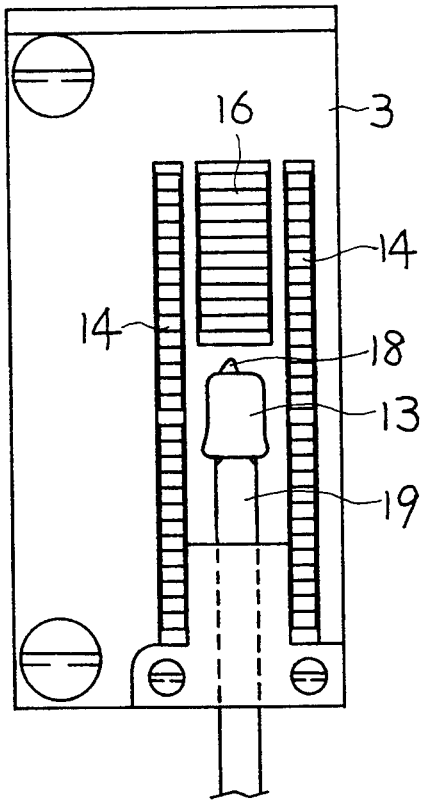
FIG. 6 is a plan view showing the state of forming a thread chain as the front end of the slender plate retreats and withdraws from within the needle hole.

The throat plate 3 comprises, as specifically shown in FIG. 4 through FIG. 6, a rectangular needle hole 13, two penetration holes 15 having feed dogs 14 disposed at opposite sides of the needle hole 13, a penetration hole 17 having a rear feed dog 16 for drawing the thread chain C disposed at the delivery side of the cloth feed direction of the needle hole 13, a V-shaped guide groove 18 extending toward the middle of the penetration hole 17 from the left side of the needle hole 13, and a slender plate 19 installed to slide back and forth along the throat plate 3, with its end projecting rectractably in the needle hole 13, and having its front end functioning as the stitch formation tongue in the projected state (FIG. 5). For forming the thread chain C, the slender plate 19 retracts its front end from the needle hole 13 when the cloth sensor detects the rear end of cloth (FIG. 6).

Figure 2:
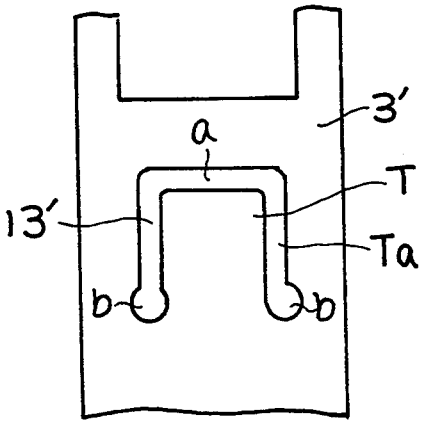
FIG. 2 is a plan view of a needle hole formed in a U-shape in a throat plate.

This slender plate 19 has parallel, straight side edges 19*a*, and will not hook the thread chain C when moving back and forth. Besides, in another case as shown in FIG. 2, when provided with a stationary stitch formation tongue T in the needle hole 13' of the throat plate 3', the thread chain C is drawn out smoothly by forming a straight edge Ta from the right side needle drop point b to the front end of the tongue T.

Incidentally, as the means for changing over the tension devices A, B and forward and backward motion of the slender plate 19, a known driving means may be used, such as a solenoid or an air cylinder.

Figure 1:
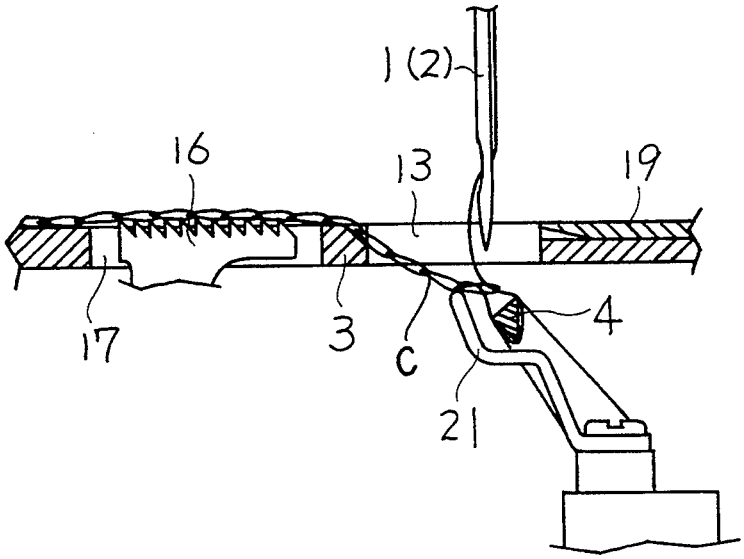
FIG. 1 is a sectional view showing a mode of drawing out a thread chain.
Figure 7:
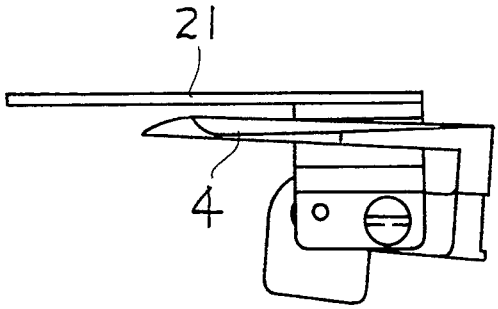
FIG. 7 is a front view of a looper mounted on an auxiliary blade.
Figure 8:
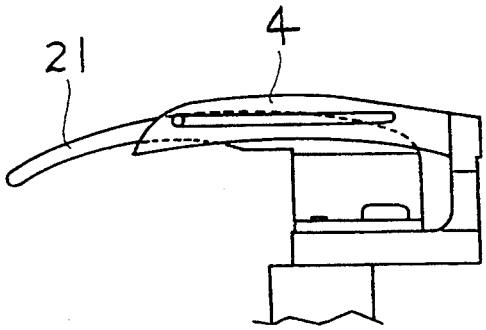
FIG. 8 is a plan view of the looper shown in FIG. 7.

The looper 4 has an auxiliary blade 21 provided in parallel to and apart from its back side as shown in FIGS. 1, 7 and 8, and the front end of the auxiliary blade 21 projects ahead of the front end of the looper 4 by the length of the oscillating stroke of the looper 4.

Figure 9:
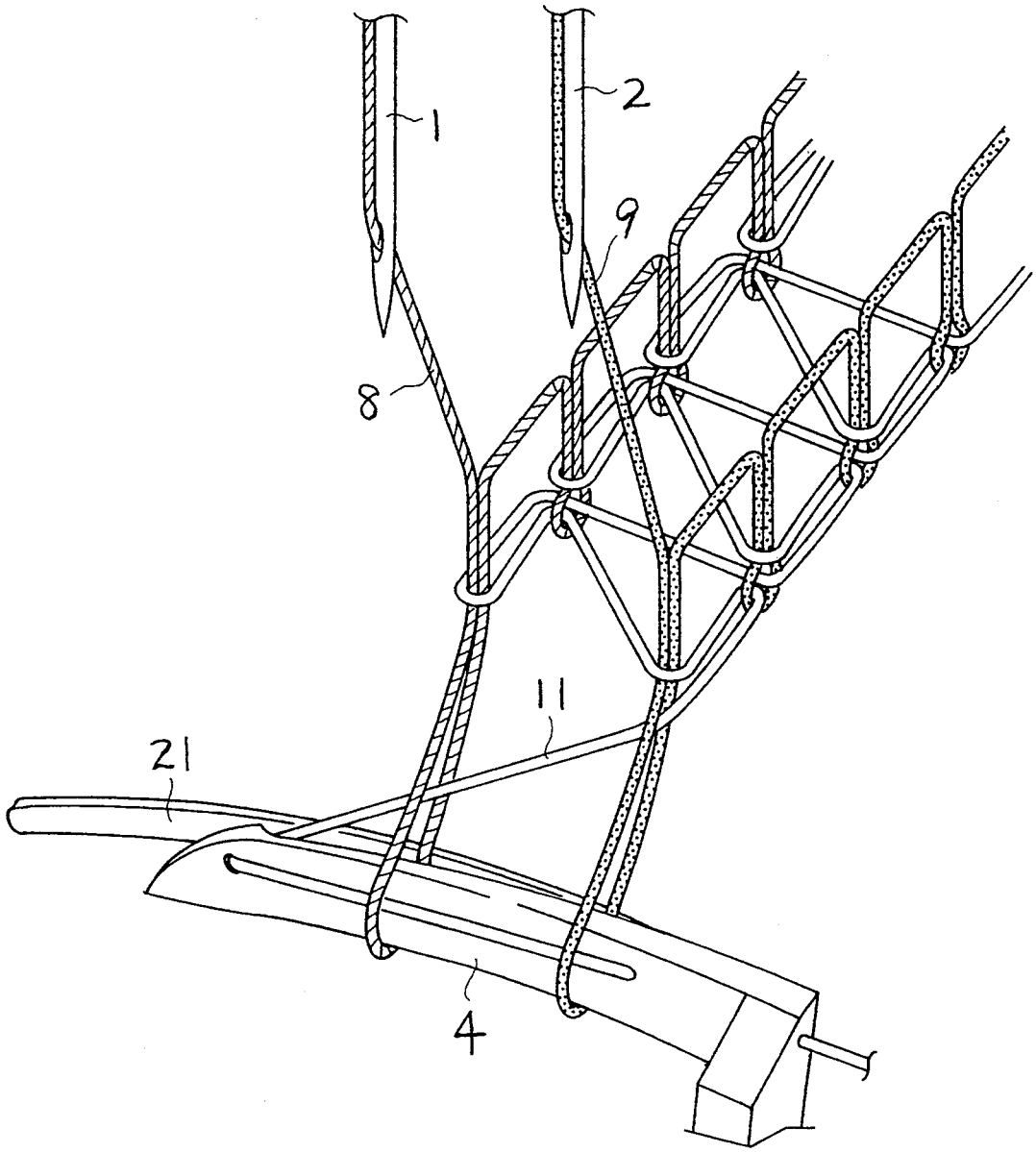
FIG. 9 is a perspective view showing stitches at the time of sewing, without showing the fabric to be sewn.

The sewing machine of the embodiment is constituted in this way, and when sewing, the front end of the slender plate 19 projects into the needle hole 13 (FIG. 5), and the tension device of row B for thread chain C in FIG. 3 is released, and the sewing is effected in the state of providing the needle threads 8, 9 and looper thread 11 with a tension by the tension device of row A for sewing. FIG. 9 shows the U.S. Federal Standard stitch type 406 formed in this operation.

Figure 10:
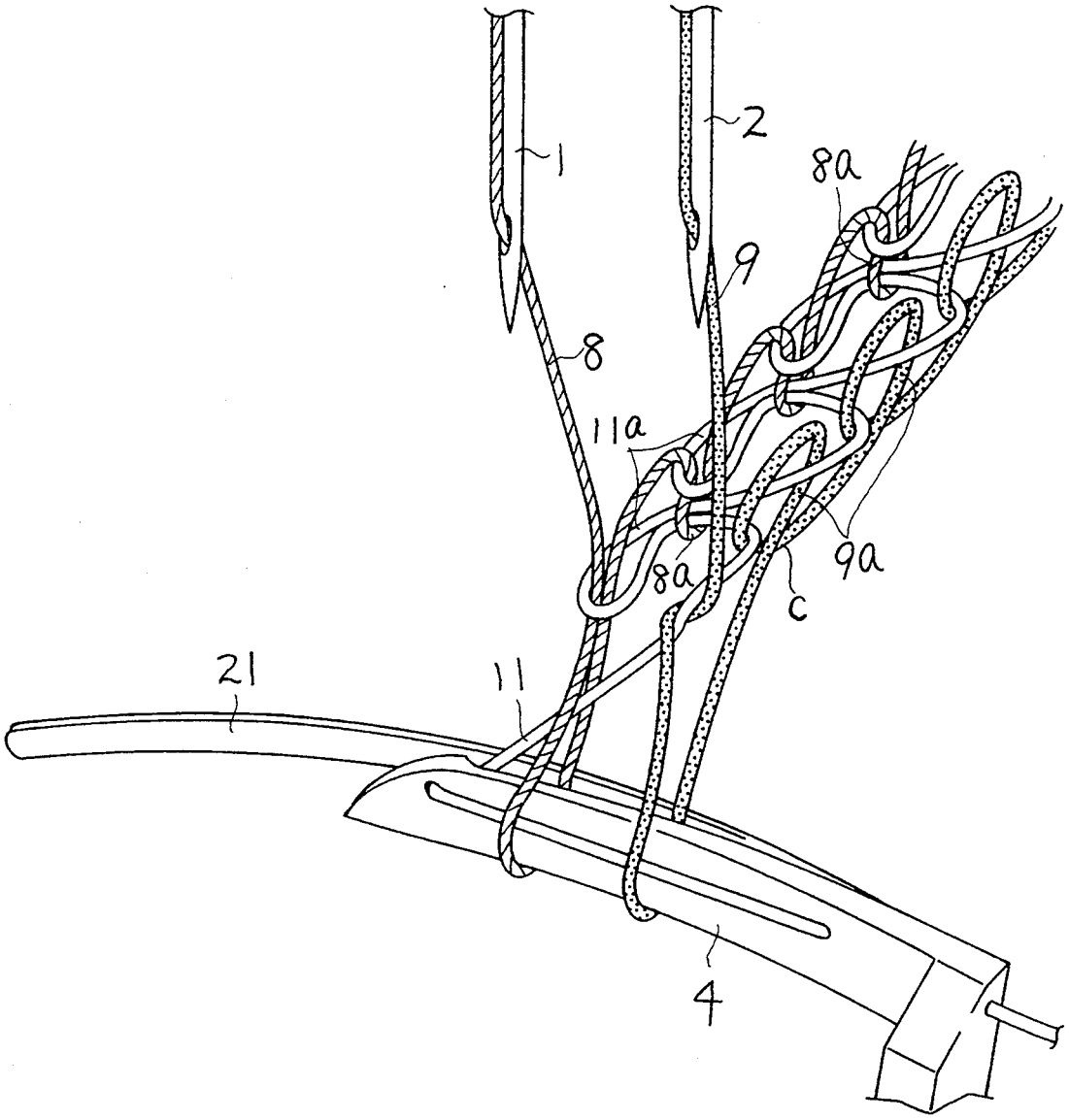
FIG. 10 is a perspective view showing a process for forming a thread chain.

After sewing, when the fabric rear end goes past the cloth sensor and is detected by the sensor, the slender plate 19 retracts, its front end is withdrawn from the needle hole 13, the tension devices are changed over, the tension device of row A for sewing is released, and tension is applied to the threads by the tension device of row B for the thread chain C. That is, the tension of the left needle thread 8 is unchanged, the tension of the right needle thread 9 is reduced and the tension of the looper thread 11 increased, so that the right needle thread 9 with the lower tension is pulled by the looper thread 11 and shifted to the left needle thread 8 side. As a result, the left needle 1 is, as in the case of sewing, placed within the triangle formed by the looper 4, the loop of the needle thread 8 hooked on the looper 4, and the looper thread 11, while the right needle 2 falls outside (the right side in FIG. 10) of the loop of the needle thread 9 applied on the looper 4, and since the right needle thread 9 has a low tension and inverts, being overcome by the tension of the looper thread 11, the closed loop 9*a* can be repeated continuously. The loop 11*a* of the looper thread passing through the closed loop 9*a*, passes through each loop 8*a* of the needle thread 8, and forms the thread chain C in a form of enclosing the loop 8*a* just before it.

The thread chain C thus formed is shifted to the loop 8*a* side of the needle thread 8, without being interfered with by the front end of the slender plate 19 in the needle hole 13, by the looper thread 11, which tension is intensified by the loop 9*a* of the needle thread 9 having a reduced tension, thereby forming one string, which passes through the guide groove 18 in a state of being supported by the auxiliary blade 21, and is led toward the middle of the rear feed dog 16, and is drawn out by the rear feed dog 16.

Figure 11:
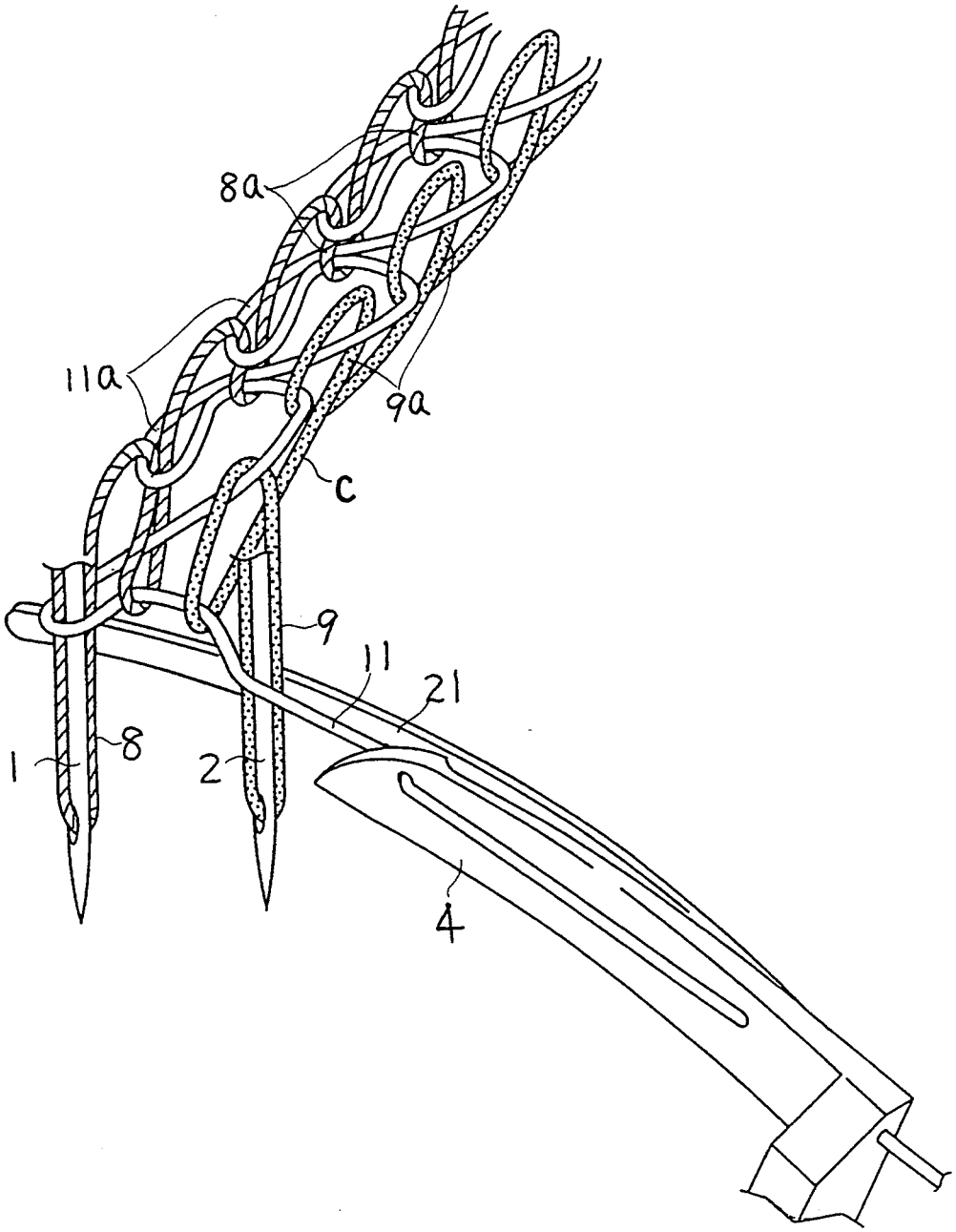
FIG. 11 is a perspective view showing the state of retreat of the looper as the needle reaches the bottom end point when forming a thread chain.

The front end of the auxiliary blade 21 extends ahead of the looper 4 and is always at the left side of the left needle 8, and holds the thread chain C until the looper 4 retracts and the needles 1, 2 reach the lower end point (FIG. 11), thereby preventing its descent. Hence, if the looper 4 moves forward, it will not hook the thread chain C.

I claim:

1. A method for drawing out a thread chain in a sewing machine which forms a double chain stitch without an upper cover thread through the cooperation of at least two needles and a primary blade of a looper, said method comprising the steps of: providing an auxiliary blade on said looper, said auxiliary blade being oriented parallel to said primary blade; supporting said thread chain on said auxiliary blade at a position adjacent to and at a cloth delivery side of the primary blade when sewing is completed; feeding the thread chain through a needle hole and over a guide groove formed in a throat plate in a direction opposite to a cloth feed direction to a rear feed dog; and drawing the thread chain onto the throat plate by the rear feed dog.

2. The method of claim 1, further comprising the steps of: providing a movable stitch formation tongue, said stitch formation tongue extending into said needle hole during sewing and withdrawing from said needle hole when sewing is completed and said thread chain is to be formed.

3. A method for drawing out a thread chain in a sewing machine which forms a double chain stitch without an upper cover thread through the cooperation of at least first and second needle threads respectively provided in first and second needles and a looper thread provided in a looper, said method comprising the steps of: providing the first and second needle threads with a tension suitable for sewing during the sewing of a fabric; reducing the tension on one of the needle threads and increasing the tension on the looper thread when sewing is completed; and supporting the thread chain by thread chain supporting means on the looper.

4. The method of claim 3, further comprising the steps of: feeding the thread chain through a needle hole and over a guide groove formed in a throat plate in a direction opposite to a cloth feed direction to a rear feed dog; and drawing the thread chain onto the throat plate by the rear feed dog.

5. The method of claim 4, further comprising the steps of: providing a movable stitch formation tongue, said stitch formation tongue extending into said needle hole during sewing and withdrawing from said needle hole when sewing is completed and said thread chain is to be formed.

6. The method of claim 5, further comprising the step of: guiding the thread chain through the guide groove to the rear feed dog.

7. A sewing machine for forming a double chain stitch without an upper cover thread through the cooperation of at least two needles and a primary blade of a looper and drawing out a thread chain, said sewing machine comprising: an auxiliary blade provided on said looper said auxiliary blade being oriented parallel to said primary blade and operating as means for supporting said thread chain at a position adjacent to and at a cloth delivery side of the primary blade when sewing is completed; a throat plate having a needle hole provided therein; and a rear feed dog for withdrawing the thread chain from the needle hole.

8. A sewing machine for forming a double chain stitch without an upper cover thread through the cooperation of at least first and second needle threads provided respectively in at least first and second needles and a looper thread provided in a looper, said sewing machine comprising: means on the looper for supporting a thread chain; a rectangular needle hole formed in a throat plate; a reciprocating stitch formation tongue which moves between a first position at which said tongue extends into said needle hole and forms an U-shaped opening and a second position at which said tongue is fully retracted from said needle hole; and a rear feed dog for drawing out the thread chain from the needle hole, said rear feed dog being located downstream, with respect to a cloth feed direction, of said needle hole.

9. The sewing machine of claim 8, additionally comprising a guide groove provided in said throat plate for leading said thread chain from the rectangular needle hole to said rear feed dog.

10. The sewing machine of claim 8, additionally comprising means for decreasing the tension of one of the needle threads and increasing the tension of the looper thread.

11. The sewing machine of claim 10, additionally comprising a guide groove provided in said throat plate for leading said thread chain from the rectangular needle hole to said rear feed dog.

12. A sewing machine for forming a double chain stitch without an upper cover thread through the cooperation of at least first and second needle threads provided respectively in at least first and second needles and a looper thread provided in a looper, said sewing machine comprising means on the looper for supporting a thread chain adjacent to and at a cloth delivery side of the looper, a U-shaped needle hole formed in and defining right and left needle penetrating paths in said throat plate, each of said right and left needle penetrating paths having a needle penetrating portion of an enlarged diameter, one of said needle penetrating portions having a straight inside edge extending along the needle penetrating path, and a rear feed dog disposed behind said needle hole with respect to a cloth feeding direction.

* * * * *